United States Patent [19]

Sundahl et al.

[11] 4,434,514

[45] Mar. 6, 1984

[54] BICYCLISTS HELMET WITH AIR FLOW AND PERSPIRATION CONTROL

[75] Inventors: James G. Sundahl, Irvine; Lester V. Broersma, Bellflower, both of Calif.

[73] Assignee: Bell Helmets Inc., Norwalk, Calif.

[21] Appl. No.: 337,815

[22] Filed: Jan. 7, 1982

[51] Int. Cl.[3] ..... A42C 5/04; A42B 3/00

[52] U.S. Cl. ..... 2/425; 2/171.3; 2/184.5; 2/421; 2/424; 2/181.6

[58] Field of Search ..... 2/425, 424, 410, 421, 2/10, 171.3, 181.4, 181.6, 182.2, 182.3, 171.4, 171.5, 171.7, 184.5

[56] References Cited

U.S. PATENT DOCUMENTS

| | | | |
|---|---|---|---|
| 935,556 | 9/1909 | Smith . | |
| 1,234,589 | 7/1917 | Wells | 2/181.6 |
| 1,347,046 | 7/1920 | McDonough . | |
| 2,769,176 | 11/1956 | Grancsay . | |
| 2,846,683 | 8/1958 | Dye et al. . | |
| 2,991,478 | 7/1961 | Zbikowski . | |
| 3,082,428 | 3/1963 | Zbikowski . | |
| 3,274,612 | 9/1966 | Merriam | 2/425 |
| 3,289,212 | 12/1966 | Morgan | 2/181.4 X |
| 3,310,811 | 3/1967 | Iacono, Jr. . | |
| 3,344,433 | 10/1967 | Stapenhill . | |
| 3,496,854 | 2/1970 | Feldmann et al. . | |
| 3,783,450 | 1/1974 | O'Connor . | |
| 3,873,997 | 4/1975 | Gooding . | |
| 3,925,821 | 12/1975 | Lewicki . | |
| 4,044,400 | 8/1977 | Lewicki et al. . | |
| 4,075,714 | 2/1978 | Ryder et al. | 2/425 X |
| 4,110,847 | 9/1978 | Dera | 2/421 |
| 4,115,874 | 9/1978 | Hasegawa | 2/171.3 X |
| 4,117,553 | 10/1978 | Bay | 2/10 |
| 4,141,085 | 2/1979 | Adams, Sr. | 2/410 |
| 4,305,160 | 12/1981 | Sundahl | 2/424 |

FOREIGN PATENT DOCUMENTS

| | | | |
|---|---|---|---|
| 2075820 | 11/1981 | United Kingdom | 2/425 |

*Primary Examiner*—Peter P. Nerbun

*Attorney, Agent, or Firm*—William W. Haefliger

[57] ABSTRACT

A bicyclist's helmet comprises:

(a) an outer shell containing distributed openings through which air streams may enter the helmet, (b) a liner in said outer shell and supporting same adjacent such openings, (c) the liner forming left and right air flow channels communicating with the openings, the channels openly facing the interior of the helmet lengthwise of the channels for conducting air toward the rear of the helmet.

In addition, a screen may be located over at least one of the channels; the openings may be transversely elongated and have narrow slit width to increase air pickup yet maintain helmet strength; a removable brow perspiration pad may be employed inwardly of a frontal opening in the helmet; an adjustable visor may be incorporated in the helmet; and a quickly attachable and detachable connection may be employed on the helmet retention system.

28 Claims, 9 Drawing Figures

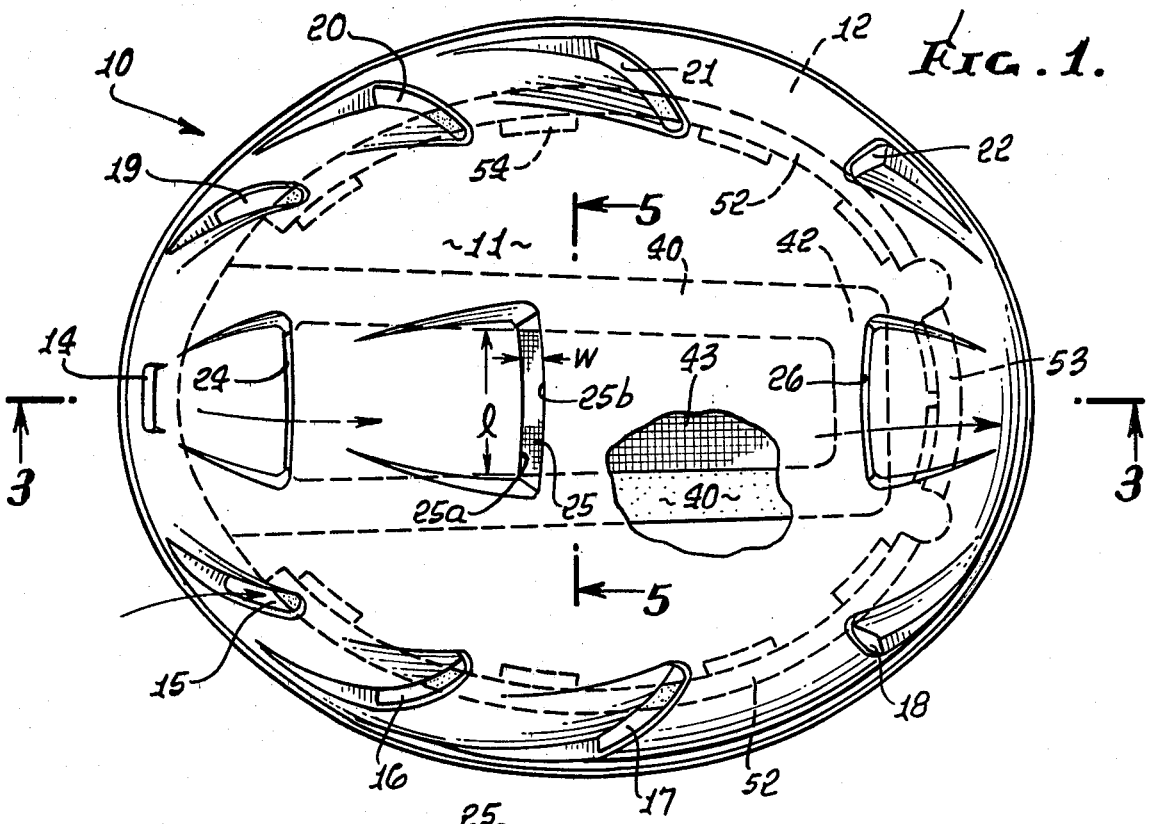
FIG. 1.
10
12
20
21
22
19
54
52
5
~11~
40
42
14
24
W
43
26
53
25b
l
3
3
25a
25
~40~
5
15
18
16
17
52
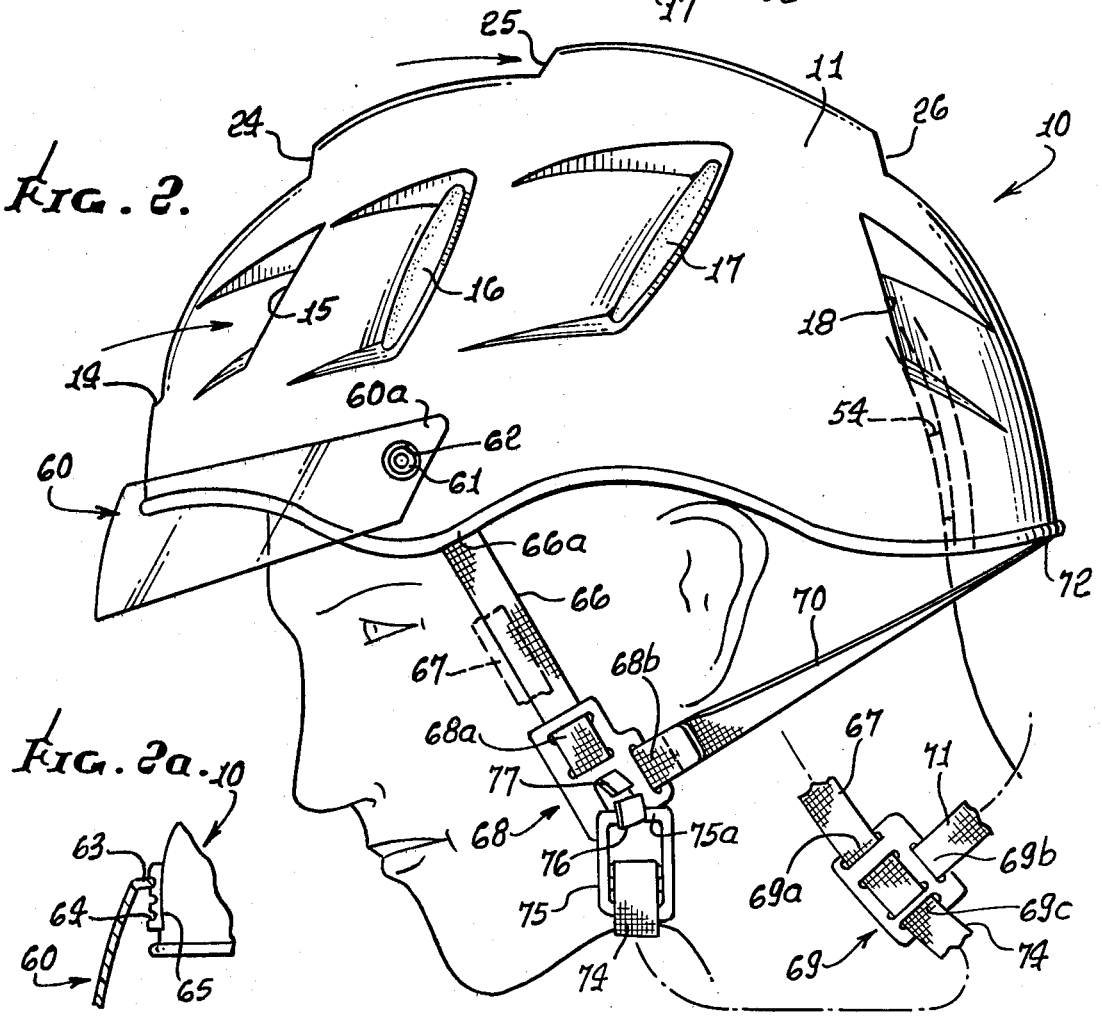
FIG. 2.
25
11
24
26
10
17
16
15
18
14
60a
54
62
60
61
66a
66
70
72
67
68b
68a
77
68
75a
76
75
74
FIG. 2a.
10
63
64
60
65
67
71
69b
69a
69c
69
74

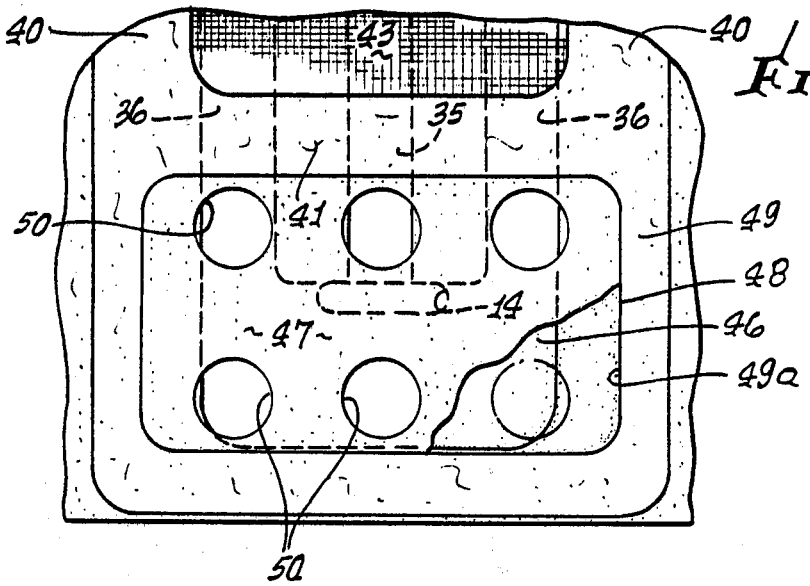
FIG. 7.
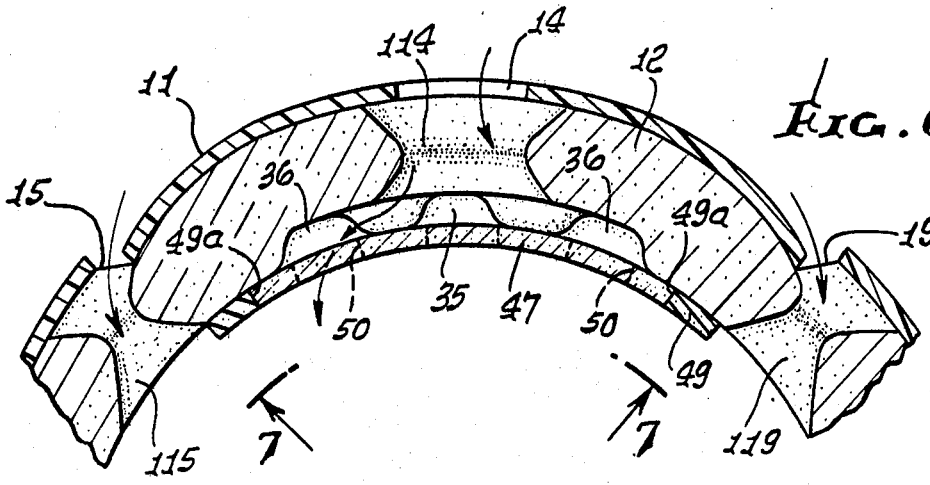
FIG. 6.
FIG. 8.
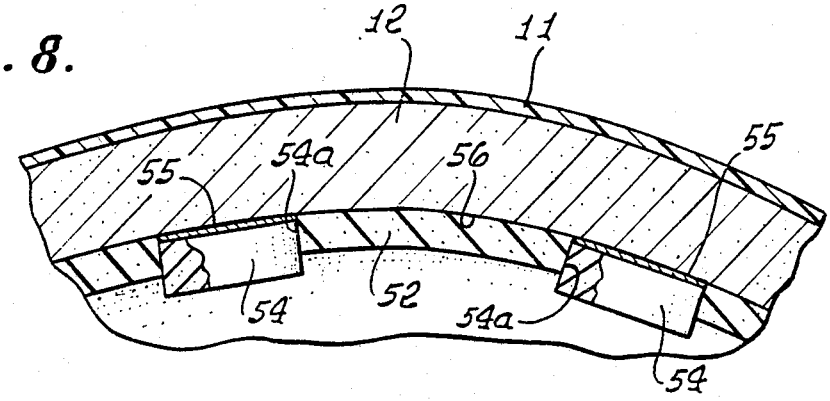

BICYCLISTS HELMET WITH AIR FLOW AND PERSPIRATION CONTROL

BACKGROUND OF THE INVENTION

This invention relates generally to helmets, and more particularly concerns a safety helmet of the type worn by bicyclists, and having a construction enhancing comfort and safety of the wearer.

In the past, it was known to provide air vents in helmets, as for example are described in U.S. Pat. No. 3,496,854 to Feldman and U.S. Pat. No. 3,925,821 to Lewicki. Such helmets lack the unusually advantageous features of construction, beneficial results and combinations thereof as are now provided by the present helmet, these including enhanced safety, air cooling, perspiration removal, and adjustability.

SUMMARY OF THE INVENTION

It is a major object of the invention to provide an improved helmet incorporating all of the above referenced advantages and results. Basically, the helmet comprises:

(a) an outer shell containing distributed openings through which air streams may enter the helmet, (b) a liner in said outer shell and supporting same adjacent said openings, (c) the liner forming left and right air flow channels communicating with said openings, the channels openly facing the interior of the helmet lengthwise of said channels for conducting air toward the rear of the helmet.

As will appear, a screen may be located within the helmet interior to extend over at least one of the channels to block entrance of the wearer's hair into the screen protected channel or channels so that air flow may continue without interruption while heat and perspiration are removed by the air flow; and the openings may be transversely elongated to increase air pickup and discharge, yet they may be formed as narrow slits outwardly of the liner, so as to maintain helmet strength and resistance to impact.

It is another object of the invention to provide a center front opening with which certain of the channels communicate at their forward ends; a brow perspiration pad may be carried by the liner to underlie that front opening and to engage the brow of the wearer, the pad, which may be perforate, being cooled by air streams entering the front opening; and the pad may be removably positioned by padding in the helmet liner so as to be quickly removable for wringing out, drying and replacement in the liner.

Further, an adjustable pivoted visor may be provided, and characterized as snapping free of connection to the helmet in response to impact; and a retention system of unusually advantageous construction is provided.

These and other objects and advantages of the invention, as well as the details of an illustrative embodiment, will be more fully understood from the following description and drawings, in which:

DRAWING DESCRIPTION

FIG. 1 is a plan view of a helmet embodying the invention;

FIG. 2 is a side elevation of the FIG. 1 helmet;

Figure 3:
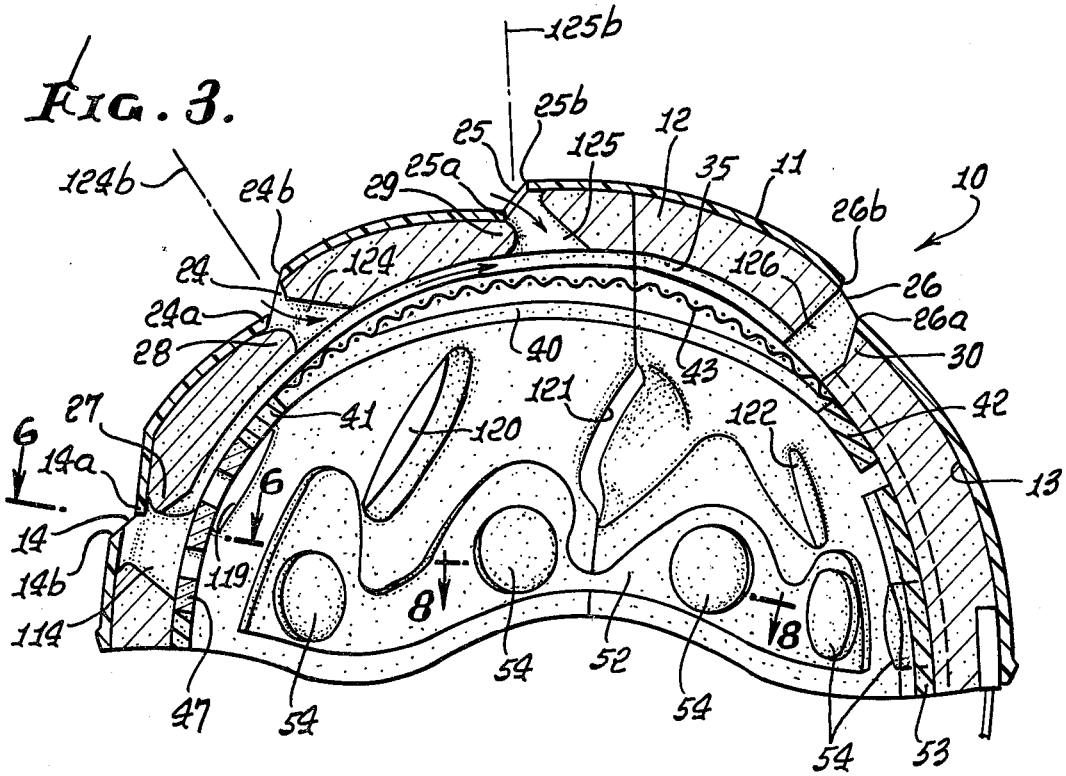
Figure 4:
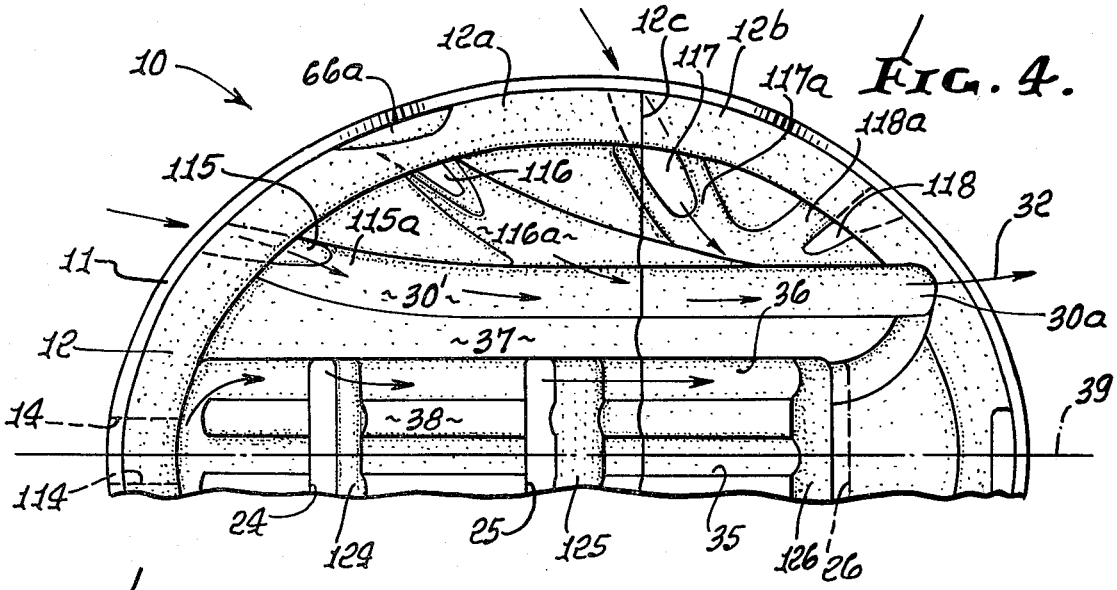
Figure 5:
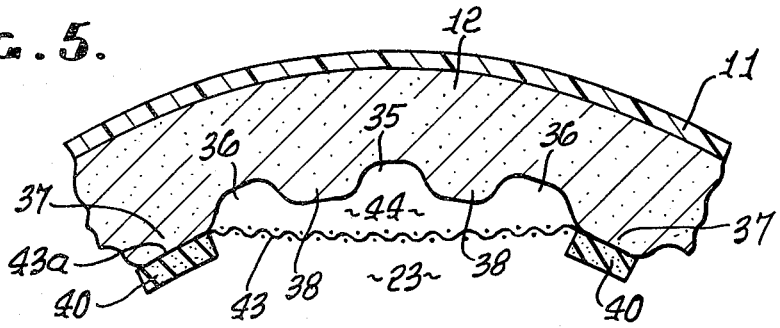

FIG. 2*a* is a fragmentary section;

FIG. 3 is an elevation taken in section on lines 3—3 of FIG. 1;

FIG. 4 is a bottom plan, fragmentary view of the FIG. 1 helmet, but showing the liner interior only;

FIG. 5 is an enlarged fragmentary section taken on lines 5—5 of FIG. 1;

FIG. 6 is an enlarged section taken on lines 6—6 of FIG. 3;

FIG. 7 is a fragmentary elevation taken on lines 7—7 of FIG. 6; and FIG. 8 is an enlarged section taken on lines 8—8 of FIG. 3.

DETAILED DESCRIPTION

In the drawings, the helmet 10 includes an outer, relatively thin, dome shaped shell 11, and an inner relatively thicker liner 12. The shell consists for example of hard, molded plastic material such as DuPont ST 801 NYLON, or polycarbonate, and the liner consists for example of semi-flexible foam plastic material such as polystyrene or polyurethane. The liner 12 is shown as formed in two sections 12*a* and 12*b*, meeting at transverse parting line or plane indicated at 12*c*. The liner sections may be suitably rigidly bonded at 13 to the shell inner surface.

The shell contains or forms a number of air passing openings, including a front opening 14; a series of left side openings 15–18; a series of right side openings 19–22; and a series of top openings 24–26. Such openings define transversely elongated, narrow slits of substantially constant width, and are characterized in that they do not have edges offset inwardly into the helmet interior 23 (as in U.S. Pat. No. 3,925,821) but rather the opening edges remain outwardly spaced from the helmet interior, so that impact loading on the shell is transferred to the outer portions of the liner, for enhanced protective and cushioning effect. See in FIG. 3, for example, the front and top opening edges 14*a*, 24*a*, 25*a* and 26*a*, which remain at the outer side of the liner, to be cushioned against liner portions 27–30 in the event of impact loading, for enhancing the protection of the wearer.

The substantially constant, narrow width of a typical slit-shaped shell opening is indicated by the letter "w" in FIG. 1, applied to opening 25, having spaced generally parallel edges 25*a* and 25*b*. Width "w" remains substantially the same over the transversely elongated, arcuate length "l" of the opening. Length "l" is at least about four times greater than width "w", whereby air entering the opening is distributed transversely to much greater extent than is characteristic of the air entrances shown in U.S. Pat. No. 3,925,821. Accordingly, cooling effect is enhanced. These same dimensional criteria apply to openings 15–18, 19–22, and 24–26. FIG. 3 also shows shell opening edges 14*b*, 24*b*, and 26*b*.

It will also be noted that openings 14–17, 19–21, 24 and 25 face generally forwardly to receive in-flow of air, whereas openings 18, 22 and 26 face generally rearwardly to discharge or vent air flowing from the helmet interior, as will further appear. In addition, the liner sections also contain through openings spaced inwardly from the shell openings, but in general registration therewith, so that the liner openings also have the transverse elongation corresponding to that of the shell openings. See liner front opening 114, liner left side openings 115–118, liner right side openings 119–122, and liner top openings 124–126. Openings 114, 115–117, 119–121, 124 and 125 conduct the inflowing air to flow channels in the liner sections, and openings 118, 122 and 126 conduct air flow from such channels to the exterior. See in this regard like left and right side channels 30' which extend longitudinally rearwardly from the inlet openings 115 and 119 to terminate at the rear of the liner, as seen at 30*a*, as seen in FIG. 4. Incoming air from inlet openings 115, 116 and 117 flows into the left channel 30' via recessed paths 115*a*, 116*a* and 117*a*, and air leaves that channel as shown by arrow 32. Similarly, air from inlet openings 19–21 flows into right side channel 30' and discharges therefrom at the rear of the liner. Also, air flowing into opening 117 in part flows via recessed paths 117*a* and 118*a* to discharge via openings 118 and 18; and air flowing into opening 21 in part flows via corresponding recessed paths to discharge via openings 122 and 22.

Similarly, a longitudinally extending center channel 35, and left and right channels 36 parallel to channel 35 and at opposite sides thereof in the liner sections, intersect the top openings 124, 125 and 126. Air flowing in via openings 124 and 125 passes along these three channels and exits via rear opening 126.

Lands 37 formed by the liner inner wall separate the channels 30' and 36; and lands 38 separate the channels 36 and 35, at laterally opposite sides of vertical longitudinal plane 39, seen in FIG. 5. Longitudinally extending foam padding strips 40 are bonded to lands 27, as seen in FIGS. 3 and 7; and transverse padding strips 41 and 42 extend between the strips 40 at opposite ends thereof, and attach to the liner inner surface. Accordingly, the strips 40–42 extend peripherally about centrally open, top interior portion 44 of the liner, across which a mesh or screen 43 extends. The periphery 43*a* of the screen is secured to the liner by the padding strips 40, under which it extends. The screen in turn blocks entrance or access of the helmet wearer's hair into the air flow channels 35 and 36, but at the same time allows air flow therein to entrain heat and perspiration from the top of the wearer's head to be carried to the exterior via the channels 35 and 36 and opening 126. See also FIG. 5.

As seen in FIGS. 3, 6 and 7 the front opening 14 in the shell, and liner opening 114, communicate with forward ends of channels 35 and 36, via space 46 which is in turn covered by a perspiration absorbing pad 47. The latter is shown to have generally rectangular form and is peripherally frictionally retained at 48 by matching inner edge 49*a* of padding 49. Pad 47 is removable, whereas padding 49 is bonded to the liner inner surface. Further, pad 47 contains multiple through openings 50 to allow air flow therethrough, whereby air in the space 46 (received via front opening 14 and exiting via channels 35 and 36) may circulate to the brow of the wearer, to cool same. When pad 47 is soaked with perspiration, it may be quickly grasped and pulled out to be wrung out, and then just as quickly replaced, as by the wearer during the course of a bicycle race. Space 46 overlies opening 14 and the front ends of channels 35 and 36, and underlies pad 47.

Side and rear padding sections 52 and 53 are also bonded to the liner interior surface, as shown, and padding buttons 54 are attached to that surface as by tape 55. Buttons are received in openings 54*a* in the padding 52 and 53, and project inwardly beyond the inner surfaces of sections 52 and 53, for engagement with the head of the wearer, at limited locations. See FIG. 8 in this regard. Adherent tape 55 may be removable from the liner surface 56.

FIGS. 2 and 2*a* show the provision of visor 60 which is generally C-shaped, and has rear terminals 60*a* pivotally attached to opposite sides of the helmet. For that purpose, studs 61 on the helmet may be received into openings 62 in the visor terminals, and the visor is flexible to snap free of the studs in response to frontal impacts. The visor may consist of darkened, transparent, molded plastic sheet material. FIG. 2*a* shows a detent means consisting of a lug 63 on the front of the visor selectively engageable into slots 64 formed in a molded part 65 on the front of the helmet, whereby the position of the visor may be adjusted up or down. Other detent means may be provided.

FIG. 2 also shows the provision of a helmet retention system comprising left and right retention strap sections 66 and 67 attached to the helmet (see attachment 66*a* for section 66, for example); left and right clips 68 and 69 respectively attached to the sections 66 and 67 as at 68*a* and 69*a*, for example, and rear strap sections 70 and 71 attached to the helmet at 72. Section 71 is attached to clip 69 as at 69*b*, and section 70 is attached to clip 68 as at 68*b*. Clip 69 is shown shifted out of position, for clarity.

A connector strap section 74 is attached at one end to clip 69 at 69*c*, and is also attached at its opposite end to a connector 75. The latter is loop shaped and has a cross piece 75*a* that is removably supported by a hook 76 integral with molded plastic clip 68. A cantilevered retainer 77 integral with clip 68 is adapted to be deflected when connector cross piece 75*a* is applied into the hook, or removed therefrom; and otherwise, the retainer retains or blocks removal of the cross-piece off the hook. The act of applying the cross-piece to the hook serves to yieldably deflect the retainer inwardly, to unblock application of the connector to the hook, whereby a very rapid hook-up of the retention system is achieved. This is facilitated by the flat planar shape of the clip 68 which presses against the cheek of the wearer, to support the clip during such hook-up.

In FIG. 3, note that liner openings 124 and 125 are offset from perpendiculars 124*b* and 125*b* normal to the shell at the shell openings 24 and 25.

I claim:

1. In a forwardly extending protective helmet, the combination including (a) an outer shell containing distributed openings located inwardly of a dome defined by the shell outer surface through which air streams may enter the helmet, said openings defined by transversely elongated, narrow slits of substantially constant width along the lengths of the openings, (b) a liner in said outer shell and supporting same adjacent said openings, (c) the liner forming left and right air flow channels communicating with said openings, the channels openly facing the interior of the helmet lengthwise of said channels for conducting air toward the rear of the helmet, (d) each slit having two elongated edges, one of which is closer to the helmet interior than the other, the liner extending into proximity to said edges at the inner side of said shell and forming additional through openings in registration with said slits.

2. The helmet of claim 1 including a screen extending within the interior of the helmet and over at least one of said channels to block entrance of the wearer's hair into said one channel.

3. The helmet of claim 2 wherein said liner has an uppermost domed portion defining said one channel, and said screen underlies said domed portion.

4. The helmet of claim 2 including padding carried by said liner peripherally adjacent said screen to engage the wearer's head.

5. The helmet of claim 1 wherein said helmet extends forwardly and rearwardly, certain of said openings facing forwardly.

6. The helmet of claim 5 wherein others of said openings at the rear of the helmet face generally rearwardly.

7. The helmet of claim 1 wherein one of said openings is at the center front of the helmet, and certain of said liner channels communicate directly with said one front and center opening.

8. The helmet of claim 1 including a brow perspiration pad carried by the liner to underlie a front opening through the shell and liner, and exposed for engagement with the wearer's forehead.

9. The helmet of claim 8 wherein said perspiration pad contains at least one through opening and is removably supported so that it may be pulled free of the liner for removal of perspiration therefrom.

10. The helmet of claim 9 including head engaging padding carried on the liner and peripherally and removably supporting the perspiration pad.

11. The helmet of claim 3 wherein others of said channels are located in said liner at opposite sides of said domed portion, and extend generally frontwardly and rearwardly relative to the helmet.

12. The helmet of claim 3 wherein two of said openings are located relatively forwardly and rearwardly of the helmet, the front opening facing forwardly to pass air from the helmet exterior to said one channel which faces the screen, the rear opening facing rearwardly to receive air from said one channel.

13. The helmet of claim 1 including foam buttons removably carried by the liner, for engagement with a wearer's head, the buttons spaced from said channels.

14. The helmet of claim 1 including a visor pivotally carried by the helmet, and having detent connection with the helmet for adjustable positioning of the visor in each of at least two positions.

15. The helmet of claim 14 wherein the helmet carries pivots to which the visor has removable connections.

16. The helmet of claim 1 wherein the shell consists of NYLON.

17. The helmet of claim 16 wherein the liner consists of polycarbonate.

18. The helmet of claim 1 including a visor extending across the front periphery of, and pivotally attached to the helmet.

19. The helmet of claim 18 including detent means on the helmet for retaining the visor in selected positions.

20. The helmet of claim 1 including a helmet retention system comprising left and right side retention strap sections attached to the helmet, left and right clips attached to said respective sections, rear strap sections attached to the helmet and to the clips, a connector strap section attached to one of the clips and to a connector, the connector detachably connectible with the other clip.

21. The helmet of claim 20 wherein said other clip consists of molded plastic material and defines a hook to which said connector is removably supported, and a cantilevered retainer adapted to be deflected when the connector is applied to the hook or removed therefrom, and which otherwise retains the connector against removal from the hook, said other clip having generally flat planar configuration.

22. In a forwardly extending protective helmet having a top and opposite sides, the helmet including a shell and a protective liner in the shell, the combination comprising (a) at least two forwardly facing air inlet openings formed in each of said opposite sides of the helmet shell, one of said two openings spaced generally forwardly of the other, (b) each of said openings being elongated upwardly and rearwardly and having overall length substantially greater than its width as measured along the major extent of said length, (c) each opening defined by and between shell elongated edges one of which substantially throughout its length is spaced closer to the helmet interior than the other edge, said edges extending upwardly and rearwardly to be inclined rearwardly relative to the top of the helmet, and said edges extending in generally parallel relation through their lengths, (d) the liner extending into proximity to said edges at the inner side of the shell and forming additional through openings in registration with said openings in the shell.

23. The combination of claim 22 wherein there are three of said forwardly facing openings in each of said opposite sides of the helmet.

24. The combination of claim 22 including at least two additional forwardly facing air inlet openings formed in the top of the helmet, one of said two additional openings spaced generally forwardly of the other, each of said two additional openings being elongated transversely of the helmet top and having overall length substantially greater than its width as measured along the major extent of said length.

25. The combination of claim 24 wherein each of said additional openings is defined between helmet elongated edges one of which substantially throughout its length is spaced closer to the helmet interior than the other of said edges.

26. In a forwardly extending protective helmet, the combination including (a) an outer shell containing distributed openings located inwardly of a dome defined by the shell outer surface through which air streams may enter the helmet, said openings defined by transversely elongated, narrow slits of substantially constant width along the lengths of the openings, (b) a liner in said outer shell and supporting same near said openings, (c) the liner forming left and right air flow channels commuicating with said openings, the channels openly facing the interior of the helmet lengthwise of said channels for conducting air toward the rear of the helmet, (d) each slit having two elongated edges, one of which is closer to the helmet interior than the other, the liner forming additional elongated through openings which are in registration with said elongated slits and which are located closer to the helmet interior than said edges, whereby the slit edges are protectively spaced from the helmet interior.

27. In a forwardly extending protective helmet having a top and opposite sides, the helmet including a shell and a protective liner in the shell, the combination comprising (a) at least two forwardly facing air inlet openings formed in each of said opposite sides of the helmet shell, one of said two openings spaced generally forwardly of the other, (b) each of said openings being elongated upwardly and rearwardly and having overall length substantially greater than its width as measured along the major extent of said length, (c) each opening defined by and between shell elongated edges one of which substantially throughout its length is spaced closer to the helmet interior than the other edge, said edges extending upwardly and rearwardly to be inclined rearwardly relative to the top of the helmet, and said edges extending in generally parallel relation through their lengths, (d) the liner forming additional elongated through openings which are in registration with said elongated openings in the shell, and which are located closer to the helmet interior than said edges, whereby the shell edges are protectively spaced from the helmet interior.

28. The combination of claim 27 including at least two additional forwardly facing air inlet openings formed in the shell at the top of the helmet, one of said two additional openings spaced generally forwardly of the other, each of said two additional openings being elongated transversely of the helmet top and having overall length substantially greater than its width as measured along the major extent of said length, and defined between generally parallel opposite edges.

* * * * *